United States Patent [19]

Brereton

[11] Patent Number: 4,537,672

[45] Date of Patent: Aug. 27, 1985

[54] ELECTROLYTIC CELL

[75] Inventor: Colin Brereton, Middlewich, England

[73] Assignee: Imperial Chemical Industries, PLC, England

[21] Appl. No.: 574,245

[22] Filed: Jan. 26, 1984

[30] Foreign Application Priority Data

Feb. 9, 1983 [GB] United Kingdom ..... 8303586

[51] Int. Cl.[3] ..... C25B 13/08; C25B 9/00; C25B 11/04

[52] U.S. Cl. ..... 204/253; 204/279; 204/282; 204/296; 204/292

[58] Field of Search ..... 204/252–258, 204/263–266, 282–283, 279, 292

[56] References Cited

U.S. PATENT DOCUMENTS

| | | | |
|---|---|---|---|
| 2,871,179 | 1/1959 | Zdansky | 204/256 |
| 4,069,129 | 1/1978 | Sato et al. | 204/258 |
| 4,252,628 | 2/1981 | Boulton et al. | 204/257 |
| 4,312,736 | 1/1982 | Menth et al. | 204/255 |
| 4,378,286 | 3/1983 | Eng et al. | 204/257 |

*Primary Examiner*—Donald R. Valentine

*Attorney, Agent, or Firm*—Cushman, Darby & Cushman

[57] ABSTRACT

An electrolytic cell comprising a plurality of anodes and a plurality of cathodes, and a hydraulically impermeable cation-exchange membrane and a gasket of an electrically insulating material positioned between each adjacent anode and cathode to form in the cell a plurality of separate anode and cathode compartments, in which either (a) the cation-exchange membrane is in contact with the anode at least around the periphery of the anode and the gasket is positioned between the membrane and the cathode and abuts onto that part of the membrane which is in contact with the periphery of the anode, or (b) the cation-exchange membrane is in contact with the cathode at least around the periphery of the cathode and the gasket is positioned between the membrane and the anode and abuts onto that part of the membrane which is in contact with the periphery of the cathode.

9 Claims, 3 Drawing Figures

ELECTROLYTIC CELL

Figure 1:
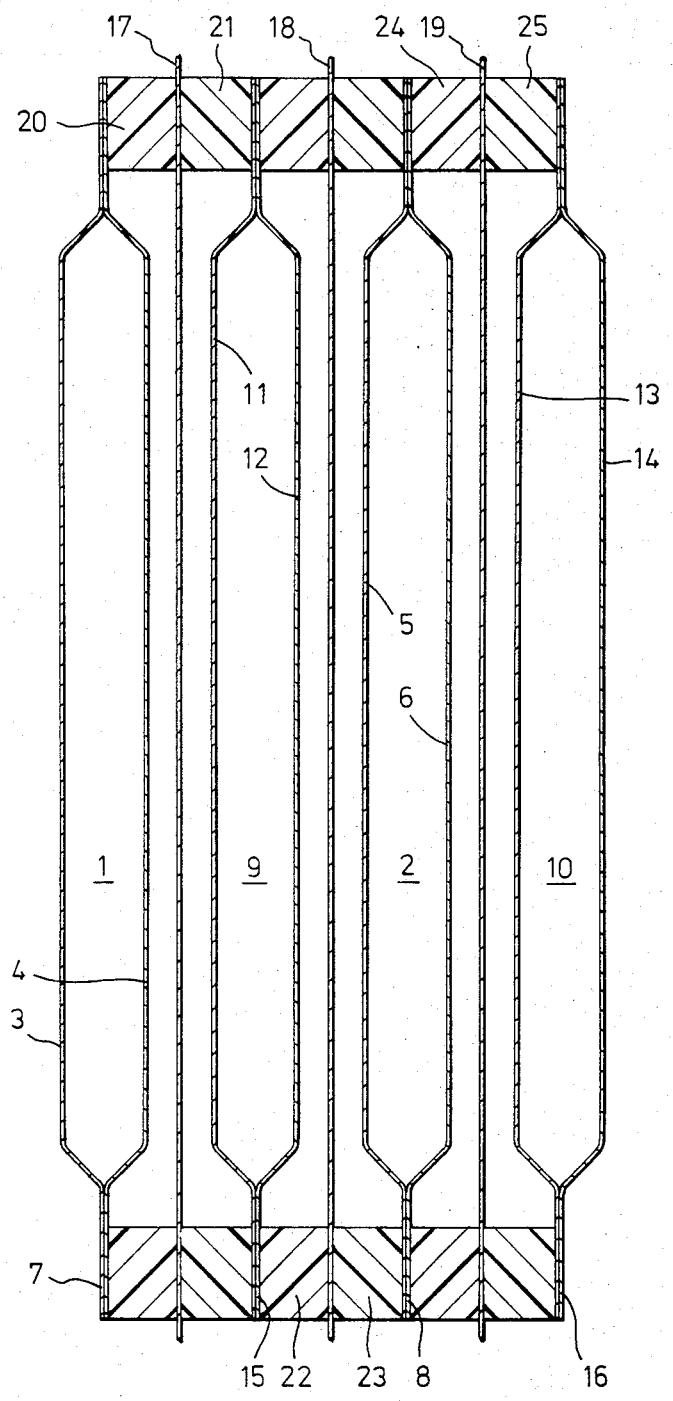

This invention relates to an electrolytic cell and in particular to an electrolytic cell of the filter press type containing a cation-exchange membrane.

Electrolytic cells are known comprising a plurality of anodes and cathodes with each anode being separated from the adjacent cathode by a separator which divides the electrolytic cell into a plurality of anode and cathode compartments. The anode compartments of such a cell are provided with means for charging electrolyte to the cell, suitably from a common header, and with means for removing products of electrolysis from the cell. Similarly, the cathode compartments of the cell are provided with means for removing products of electrolysis from the cell, and optionally with means for charging water or other fluids to the cell, suitably from a common header. Such electrolytic cells may be of the monopolar or bipolar type, and generally comprise one or more gaskets of an electrically insulating material positioned between each adjacent anode and cathode so as to electrically insulate the adjacent anodes from the adjacent cathodes.

Electrolytic cells of the filter press type may comprise a large number of alternating anodes and cathodes, for example, fifty anodes alternatively with fifty cathodes, although the cell may comprise even more anodes and cathodes, for example up to one hundred and fifty alternating anodes and cathodes.

In recent years electrolytic cells of the filter press type have been developed for use in the production of chlorine and aqueous alkali metal hydroxide solution by the electrolysis of aqueous alkali metal chloride solution, particularly cells in which the separator is a substantially hydraulically impermeable cation-exchange membrane. Where aqueous alkali metal chloride solution is electrolysed in an electrolytic cell of the membrane type the solution is charged to the anode compartments of the cell and chlorine produced in the electrolysis and depleted alkali metal chloride solution are removed from the anode compartments, alkali metal ions are transported across the membranes to the cathode compartments of the cell to which water or dilute alkali metal hydroxide solution is charged, and hydrogen and alkali metal hydroxide solution produced by the reaction of alkali metal ions with water are removed from the cathode compartments of the cell.

In electrolytic cells in which aqueous alkali metal chloride solution is electrolysed the liquors in the anode and cathode compartments, that is a chlorine-containing alkali metal chloride solution and wet chlorine in the anode compartments and a concentrated alkali metal hydroxide solution in the cathode compartments, are corrosive, particularly the chlorine-containing alkali metal chloride solution and wet chlorine in the anode compartments.

In the electrolytic cell the gaskets of electrically insulating material come into contact with the corrosive liquors with the result that the gaskets are attacked chemically, and may be attacked to such an extent that leaks develop in the electrolytic cell. In order to avoid such chemical attack the gaskets must be made of a corrosion resistant material, particularly those gaskets which come into contact with the chlorine-containing alkali metal chloride solution and wet chlorine in the anode compartments of the cell. However, such corrosion resistant materials are generally expensive and even in the case where the gaskets are made of, or are at least surfaced with, such a corrosion resistant material, for example a fluoro-polymer, e.g. polytetrafluoroethylene, the problem of corrosion damage of the gaskets may still remain.

The present invention relates to an electrolytic cell of the ion-exchange membrane type in which the problem of corrosion of gaskets by the liquors in the anode compartments of the cell, or by the liquors in the cathode compartments of the cell, is substantially overcome.

According to the present invention there is provided an electrolytic cell comprising a plurality of anodes each having an active anode area and a plurality of cathodes each having an active cathode area, and a substantially hydraulically impermeable cation-exchange membrane and a gasket of an electrically insulating material positioned between each adjacent anode and cathode to form in the cell a plurality of separate anode and cathode copartments, characterised in that either (a) the cation-exchange membrane is in contact with the anode at least around the periphery of the anode and in that the gasket is positioned between the membrane and the cathode and abuts onto that part of the membrane which is in contact with the periphery of the anode, or (b) the cation-exchange membrane is in contact with the cathode at least around the periphery of the cathode and in that the gasket is positioned between the membrane and the anode and abuts onto that part of the membrane which is in contact with the periphery of the cathode.

The electrolytic cell may be of the monopolar or bipolar type. A cell of the monopolar type comprises a plurality of anodes and cathodes arranged in an alternating manner with a cation-exchange membrane and a gasket positioned between each adjacent anode and cathode. In a cell of the bipolar type the cell comprises a plurality of electrodes each of which has an anode surface and a cathode surface, a cation-exchange membrane and gasket being positioned between the anode surface of one electrode and the cathode surface of an adjacent electrode.

In the electrolytic cell the cation-exchange membrane is in contact with the anode, or cathode, at least around the periphery of the anode, or cathode. Thus, the membrane is in contact at least with that part of the anode, or cathode, within which the active anode area, or active cathode area, is located.

Although the anode and/or the cathode may be made of any suitable electrically conducting material they will in general both be made of metal, and the invention will be described hereafter by reference to metallic anodes and cathodes.

The anode may comprise an active anode area and a peripheral metallic area, and the cathode may comprise an active cathode area and a peripheral metallic area.

It will be appreciated that where the cation-exchange membrane is in contact with the metallic anode at least around the periphery of the anode the liquors in the anode compartments of the cell do not come into contact with the gaskets of electrically insulating material and thus cannot corrode the gaskets. This is particularly important where the liquors in the anode compartments are very corrosive, as is the case with chlorine-containing alkali metal chloride solution and wet chlorine in the electrolysis of aqueous alkali metal chloride. For this reason this is a preferred embodiment of the electrolytic cell. The liquors which do come into contact with the gaskets are the liquors in the cathode compartments of the cell.

Alternatively, where the cation-exchange membrane is in contact with the metallic cathode at least around the periphery of the cathode it will be appreciated that liquors in the cathode compartments of the cell do not come into contact with the gaskets of electrically insulating material and thus cannot corrode the gaskets. In this case the liquors which do come into contact with the gaskets are the liquors in the anode compartments of the cell.

For the sake of simplicity the invention will be described hereafter with reference to the aforementioned preferred embodiment.

Where the anodes in the electrolytic cell are metallic the nature of the metal will depend on the nature of the electrolyte to be electrolysed in the electrolytic cell. A preferred metal is a film-forming metal, particularly where an aqueous solution of an alkali metal chloride is to be electrolysed in the cell.

The film-forming metal may be one of the metals titanium, zirconium, niobium, tantalum or tungsten or an alloy comprising principally of one or more of these metals and having anodic polarisation properties which are comparable with those of the pure metal. It is preferred to use titanium alone, or an alloy based on titanium and having polarisation properties comparable with those of titanium.

The anode portion may be positioned centrally and may comprise a plurality of elongated members, which are preferably vertically disposed, for example in the form of louvres or strips, or it may comprise a foraminate surface such as mesh, expanded metal or a perforated surface. The anode portion may comprise a pair of spaced apart foraminate surfaces disposed substantially parallel to each other, or two groups of elongated members spaced apart from each other, attached to a peripheral support, and the anode may thus be of a box-like form.

The anode portion of the anode may carry a coating of an electroconducting electrocatalytically active material. Particularly in the case where an aqueous solution of an alkali metal chloride is to be electrolysed this coating may for example consist of one or more platinum group metals, that is platinum, rhodium, iridium, ruthenium, osmium and palladium, or alloys of the said metals, and/or an oxide or oxides thereof. The coating may consist of one or more of the platinum group metals and/or oxides thereof in admixture with one or more non-noble metal oxides, particularly a film-forming metal oxide. Especially suitable electrocatalytically active coatings include those based on ruthenium dioxide/titanium dioxide, ruthenium dioxide/tin dioxide, and ruthenium dioxide/tin dioxide/titanium dioxide.

Such coatings, and methods of application thereof, are well known in the art.

The anode may comprise a frame-like plate section with the active anode area, which may comprise a pair of spaced-apart forminate surfaces, positioned within and attached to the frame-like plate section. In this case the membrane may be positioned in contact with this frame-like plate section of the anode with the gasket of electrically insulating material being positioned between the membrane and the adjacent cathode and abutting onto that part of the membrane which is in contact with the frame-like plate section of the anode.

Where the cathodes in the electrolytic cell are metallic the nature of the metal will also depend on the nature of the electrolyte to be electrolysed in the electrolytic cell. Where an aqueous solution of an alkali metal chloride is to be electrolysed the cathode may be made, for example of, steel, copper, nickel or copper- or nickel-coated steel.

The cathode portion may be positioned centrally and comprise a plurality of elongated members, which are preferably vertically disposed, for example in the form of louvres or strips, or it may comprise a foraminate surface such as mesh, expanded metal or perforated surface. The cathode portion may comprise a pair of spaced apart foraminate surfaces disposed substantially parallel to each other, or it may comprise two groups of elongated members spaced apart from each other, attached to a peripheral support, and the cathode may thus be of a box-like form.

The cathode portion of the cathode may carry a coating of a material which reduces the hydrogen overvoltage at the cathode when the electrolytic cell is used in the electrolysis of aqueous alkali metal chloride solution. Such coatings are known in the art.

The cathode may comprise a frame-like plate section with the active cathode area, which may comprise a pair of spaced-apart forminate surfaces, positioned within and attached to the frame-like plate section.

The anodes and cathodes are provided with means for attachment to a power source. For example, they may be provided with extensions which are suitable for attachment to appropriate bus-bars.

The anodes and/or the cathodes may be flexible, and they may be resilient, as flexibility and resiliency assists in the production of leak-tight seals when the anodes and cathodes are assembled into an electrolytic cell.

The thickness of the metal of the anodes and cathodes is suitably in the range 0.5 mm to 3 mm.

In the case where the electrolytic cell is monopolar it is preferred that the dimensions of the anodes and cathodes in the direction of current flow are such as to provide short current paths which in turn ensure low voltage drops in the anodes and cathodes without the use of elaborate current carrying devices. A preferred dimension in the direction of current flow is in the range 15 to 60 cm.

Hydraulically impermeable cation-exchange membranes are known in the art and are preferably fluorine-containing polymeric materials containing anionic groups. The polymeric materials preferably are fluorocarbons containing the repeating groups $$[C_mF_{2m}]_M \text{ and } [CF_2-\underset{\underset{X}{|}}{CF}]_N$$

where m has a value of 2 to 10, and is preferably 2, the ratio of M to N is preferably such as to give an equivalent weight of the groups X in the range 500 to 2000, and X is chosen from $$A \text{ or } [OCF_2-\underset{\underset{Z}{|}}{CF}]_p A$$

where p has the value of for example 1 to 3, Z is fluorine or a perfluoroalkyl group having from 1 to 10 carbon atoms, and A is a group chosen from the groups:

$-SO_3H$

—$CF_2SO_3H$
—$CCl_2SO_3H$
—$X^1SO_3H$
—$PO_3H_2$
—$PO_2H_2$
—COOH and
—$X^1OH$ or derivatives of the said groups, where $X^1$ is an aryl group. Preferably A represents the group $SO_3H$ or —COOH. $SO_3H$ group-containing ion exchange membranes are sold under the tradename 'Nafion' by E I DuPont de Nemours and Co Inc and —COOH group-containing ion exchange membranes under the tradename 'Flemion' by the Asahi Glass Co Ltd.

The electrolytic cell comprises a plurality of gaskets of electrically insulating material which electrically insulate each anode from the adjacent cathodes. The gasket is desirably flexible and preferably resilient and it should be resistant to those liquors in the cell with which it comes into contact. Thus, in the case of the preferred embodiment of the cell where the cation-exchange membrane is in contact with the metallic anode at least around the periphery of the anode the gasket should be resistant to the liquors in the cathode compartments of the cell with which it comes into contact. For example, in the case where the cell is to be used to electrolyse an aqueous solution of alkali metal chloride the gasket should be resistant to corrosion by concentrated aqueous alkali metal hydroxide solution. The gasket may be made of an organic polymer, for example a polyofefin, e.g. polyethylene or polypropylene; a hydrocarbon elastomer, e.g. an elastomer based on ethylene-propylene copolymers or ethylene-propylene-diene copolymers, natural rubber, or styrene-butadiene rubber; or a chlorinated hydro-carbon, e.g. polyvinyl chloride or polyvinylidene chloride. The gasket may be a fluorinated polymeric material, for example polytetrafluoroethylene, polyvinyl fluoride, polyvinylidene fluoride, or a tetrafluoroethylenehexafluoropropylene copolymer, or a substrate having an outer layer of such a fluorinated polymeric material, although an advantage of the electrolytic cell of the invention, particularly the preferred embodiment thereof, is that in the case where an aqueous alkali metal chloride solution is electrolysed the gaskets contact only the relatively less corrosive aqueous alkali metal hydroxide solution and it is unnecessary to use such relatively expensive fluorinated polymeric materials.

The gaskets may have a frame-like structure with a central opening which in the cell forms a part of the electrode compartment.

In the electrolytic cell the electrolyte may be charged from a common header to the individual anode compartments of the cell, and the products of electrolysis may be removed from the individual anode and cathode compartments of the cell by feeding the products to common headers. The means of charging the electrolyte and removing the products of electrolysis may be separate pipes leading from a common header to each anode compartment of the electrolytic cell and separate pipes leading from each anode and cathode compartment of the electrolytic cell to common headers.

Alternatively, and in a preferred embodiment, the electrolytic cell of the invention may be formed from a plurality of anodes, cathodes, and gaskets, and the gaskets and the anodes and/or the cathodes may comprise a plurality of openings therein which in the cell together form a plurality of channels lengthwise of the cell which serve as the headers. In such a cell the means of charging the electrolyte and removing the products of electrolysis may be passageways in the walls of the gaskets and/or of the anodes and/or cathodes which connect the headers to the anode and cathode compartments of the electrolytic cell.

In this preferred embodiment, and where the membrane is in contact with the metallic anode, the anode will have a plurality of such openings which in the cell form a part of the channels lengthwise of the cell which serve as the headers, and optionally the cathode may also have a plurality of such channels.

In this preferred embodiment, and where the membrane is in contact with the metallic cathode, the cathode will have a plurality of such openings which in the cell form a part of the channels lengthwise of the cell which serve as the headers, and optionally the anode may also have a plurality of such channels.

The openings in the anodes, cathodes and gaskets may be positioned near the peripheries thereof.

The membrane may if necessary, also comprise a plurality of such openings which in the cell form a plurality of channels lengthwise of the cell. Alternatively, the membrane, which is positioned between an anode and a gasket, or between a cathode and a gasket, may be of a size such that it does not project over the openings in the anode, cathode and gasket, so that there is no necessity for it to have such openings therein.

The gasket, which may comprise a central opening defined by a frame-like section, may comprise the aforesaid openings in the frame-like section of the gasket. Similarly, the anode, or the cathode, may comprise a frame-like plate section, with the anode portion, or the cathode portion, positioned within and attached to the frame-like section. The aforesaid openings may be positioned in the frame-like section of the anode and/or of the cathode.

The gaskets and the anodes and/or the cathodes may comprise four such openings which in the electrolytic cell from a part of lengthwise channels which serve as headers. Thus, the electrolytic cell may comprise four such lengthwise channels which are respectively for supply of electrolyte, e.g. aqueous alkali metal chloride solution, to the anode compartments, for supply of other fluid, e.g. water, to the cathode compartments, for removal of electrolysis products, e.g. aqueous alkali metal chloride solution and chlorine, from the anode compartments, and for removal of products of electrolysis, e.g. aqueous alkali metal hydroxide solution and hydrogen, from the cathode compartments.

Where the anodes and/or the cathodes comprise openings which in the electrolytic cell form a part of the lengthwise channels forming the headers it is necessary to ensure that the lengthwise channels which are in communication with the anode compartments of the cell are insulated electrically from the lengthwise channels which are in communication with the cathode compartments of the cell. This electrical insulation may be achieved be means of frame-like members of electrically insulating material inserted in the openings in the anodes and cathodes which form a part of the lengthwise channels.

The invention is illustrated by the following figures in which

Figure 2:
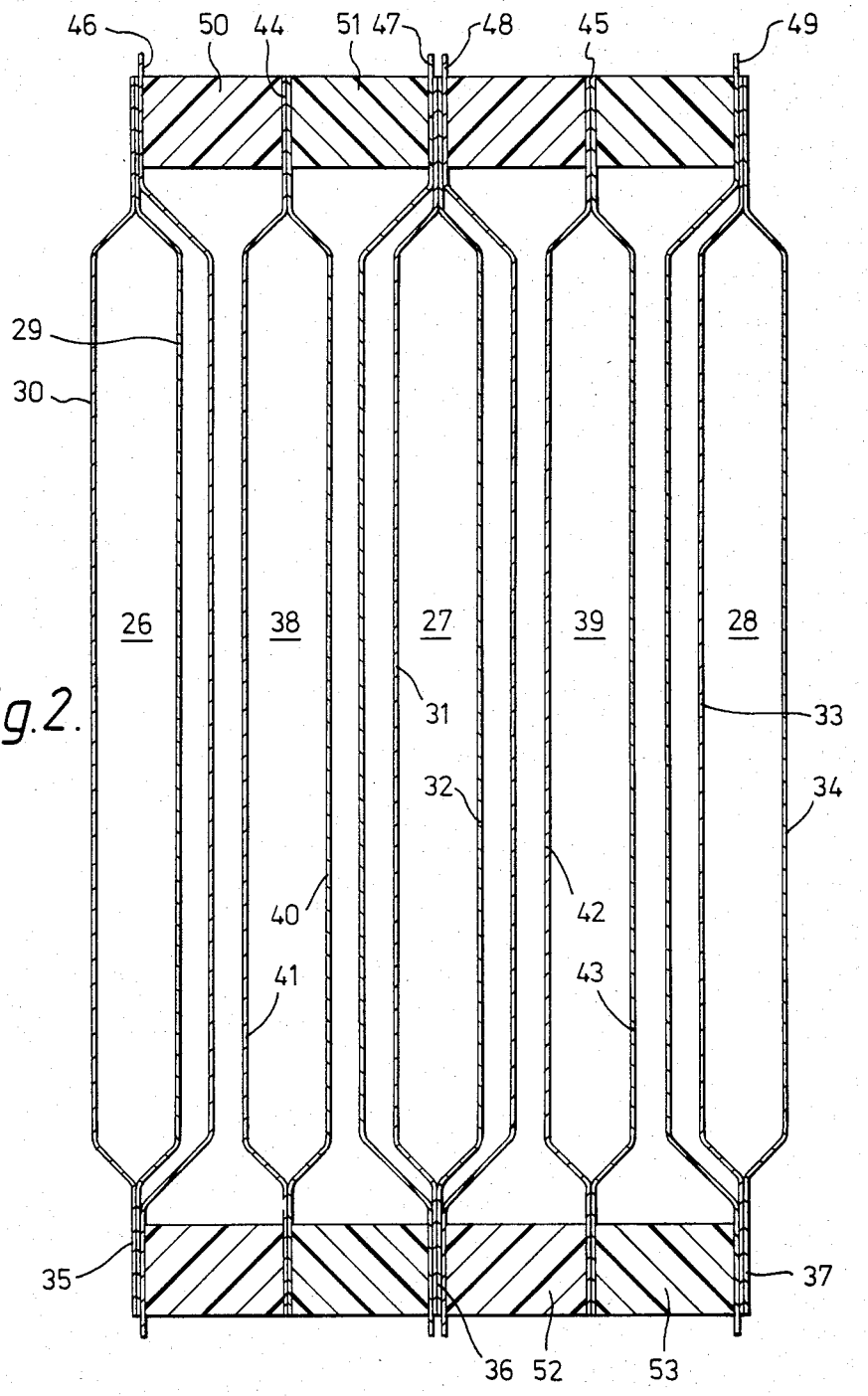
Figure 3:
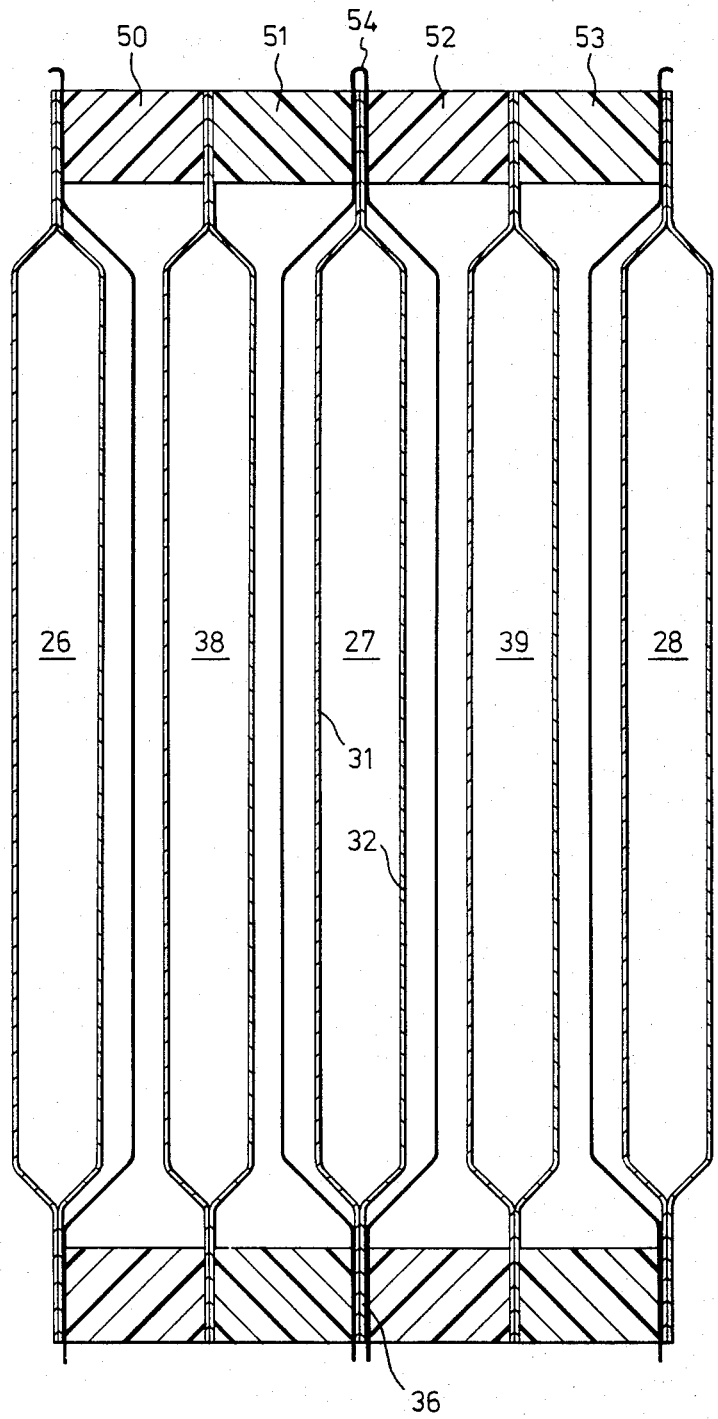

FIG. 1 is a cross-sectional view of a part of an electrolytic cell of a known type, FIG. 2 is a cross-sectional view of a part of an electrolytic cell of the invention, and FIG. 3 is a cross-sectional view of a part of an alternative embodiment of an electrolytic cell of the invention.

Referring to FIG. 1 the part of the electrolytic cell illustrated comprises two anodes (1, 2) each comprising a pair of spaced apart active anode surfaces (3, 4 and 5, 6 respectively) attached to a frame-like plate section (7, 8 respectively).

Similarly, the part of the electrolytic cell illustrated comprises two cathodes (9, 10) each comprising a pair of spaced apart active cathode surfaces (11, 12 and 13, 14 respectively) attached to a frame-like plate section (15, 16 respectively).

The electrolytic cell may contain many more anodes and cathodes than those illustrated in the FIG. 1.

Between each anode and adjacent cathode there is positioned a film of a cation-exchange membrane (17, 18, 19), each such cation-exchange membrane being positioned between a pair of gaskets of an elastomeric material (20, 21; 22, 23 and 24, 25 respectively). The electrolytic cell thus comprises an anode compartment bounded by the cation-exchange membranes (18 and 19) and a cathode compartment bounded by the membranes (17 and 18).

In the embodiment illustrated in FIG. 1 a part only of the electrolytic cell is shown. The electrolytic cell comprises many more anodes and cathodes and thus comprises a series of alternating anode and cathode compartments.

For the sake of simplicity the electrolytic cell illustrated in FIG. 1 does not show the means for feeding the electrolyte to the anode compartments nor the means for feeding other fluid, e.g. water, to the cathode compartments, nor the means for removing the products of electrolysis from the anode and cathode compartments, nor the means for electrical connection of the anodes and cathodes.

It will be appreciated that in operation the gaskets (23, 24) will come into contact with the liquors in the anode compartments and that the gaskets (21, 22) will come into contact with the liquors in the cathode compartments of the cell. Thus, where for example, the liquors in the anode compartments are very corrosive, as in the case of chlorine-containing alkali metal chloride solution and wet chlorine in the electrolysis of aqueous alkali metal chloride solution, the gaskets (23, 24) may be corroded by these liquors.

Referring to FIG. 2, the part of the electrolytic cell illustrated comprises three anodes (26, 27, 28) each comprising a pair of spaced apart active anode surfaces (29, 30; 31, 32; 33, 34 respectively) attached to a frame-like plate section (35, 36, 37 respectively). Similarly, the part of the electrolytic cell illustrated comprises two cathodes (38, 39) each comprising a pair of spaced apart active cathode surfaces (40, 41 and 42, 43 respectively) attached to a frame-like plate section (44, 45 respectively).

Between each anode and adjacent cathode there is positioned a film of a cation-exchange membrane (46, 47, 48, 49).

Membrane (46) abuts on one face against the frame-like plate section (35) of the anode (26) and on its other face against a gasket (50) which gasket in turn abuts onto the frame-like plate section (44) of cathode (38). Similarly, membrane (47) abuts on one face against the frame-like plate section (36) of anode (27) and on its other face against a gasket (51) which gasket in turn abuts onto the frame-like plate section (44) of cathode (38). Gaskets (52, 53) and membranes (48, 49) are similarly positioned.

The electrolytic cell comprises an anode compartment bounded by the cation-exchange membranes (47, 48) and cathode compartments bounded by the cation-exchange membranes (46, 47 and 48, 49 respectively).

In the embodiment illustrated in FIG. 2 a part only of the electrolytic cell is shown. The electrolytic cell comprises many more anodes and cathodes and thus comprises a series of alternating anode and cathode compartments.

In operation of the electrolytic cell it will be appreciated that, as the cation-exchange membranes (47, 48) which form the bounds of the anode compartments are in contact with the frame-like plate section (36) of the anode (27), the liquors in the anode compartments of the cell will not come into contact with the gaskets (50, 51, 52, 53). Only the liquors in the cathode compartments will come into contact with these gaskets.

For the sake of simplicity the electrolytic cell illustrated in FIG. 1 does not show the means for feeding the electrolyte to the anode compartments nor the means for feeding other fluid, e.g. water, to the cathode compartments, nor the means for removing the products of electrolysis from the anode and cathode compartments, nor the means for electrical connection of the anodes and cathodes.

In the embodiment illustrated in FIG. 3 the anode, cathodes and gaskets are numbered in the manner of FIG. 2. In this embodiment the cation-exchange membrane is in the form of a film (54) which is draped over the top of the plate-like frame section (36) of anode (27) and is positioned against the spaced apart active anode surfaces (31, 32). Use of this embodiment facilitates assembly of the electrolytic cell in a vertical mode.

I claim:

1. An electrolytic cell positioned in a vertical mode and comprising a plurality of anodes each having an active anode area and a plurality of cathodes each having an active cathode area, and a substantially hydraulically impermeable cation-exchange membrane and a gasket of an electrically insulating material positioned between each adjacent anode and cathode to form in the cell a plurality of separate anode and cathode compartments, characterised in that either (a) the cation-exchange membrane is in contact with the anode at least around the periphery of the anode, is positioned on both sides of the anode, and is in the form of a film draped over the top of the anode, and in that the gasket is positioned between the membrane and the cathode and abuts onto that part of the membrane which is in contact with the periphery of the anode, or (b) the cation-exchange membrane is in contact with the cathode at least around the periphery of the cathode, is positioned on both sides of the cathode, and is in the form of a film draped over the top of the cathode, and in that the gasket is positioned between the membrane and the anode and abuts onto that part of the membrane which is in contact with the periphery of the cathode.

2. An electrolytic cell as claimed in claim 1 characterised in that the electrolytic cell is a monopolar cell.

3. An electrolytic cell as claimed in any one of claim 1 to claim 2 characterised in that the anodes and cathodes are metallic.

4. An electrolytic cell as claimed in any one of claims 1 to 3 characterised in that the anode comprises a frame-like plate section having an active anode area positioned within and attached to the frame-like plate section.

5. An electrolytic cell as claimed in claim 4 characterised in that a cation-exchange membrane is in contact with the frame-like plate section of the anode, and in that a gasket is positioned between the membrane and the adjacent cathode and abuts onto that part of the membrane which is in contact with the frame-like plate section of the anode.

6. An electrolytic cell as claimed in claim 4 characterised in that the anodes and cathodes are flexible.

7. An electrolytic cell as claimed in claim 4 characterised in that the gaskets have a frame-like structure having a central opening.

8. An electrolytic cell as claimed in claim 1 characterised in that the cation-exchange membrane comprises a fluorine-containing polymeric material.

9. An electrolytic cell as claimed in claim 1 characterised in that the gaskets of electrically insulating material are flexible.

* * * * *